US012345251B2

(12) United States Patent
Taha et al.

(10) Patent No.: US 12,345,251 B2
(45) Date of Patent: Jul. 1, 2025

(54) WELLBORE LIFT SYSTEM WITH SPRING-ASSISTED PLUNGER

(71) Applicant: Saudi Arabian Oil Company, Dhahran (SA)

(72) Inventors: Syed Muhammad Bin Syed Taha, Dhahran (SA); Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/988,143

(22) Filed: Nov. 16, 2022

(65) Prior Publication Data

US 2024/0159233 A1 May 16, 2024

(51) Int. Cl.
*F04B 47/12* (2006.01)
*E21B 43/12* (2006.01)

(52) U.S. Cl.
CPC ..... *F04B 47/12* (2013.01); *E21B 43/121* (2013.01)

(58) Field of Classification Search
CPC ..... E21B 43/121; F04B 47/12
See application file for complete search history.

(56) References Cited

U.S. PATENT DOCUMENTS 2,038,426 A 4/1936 Fletcher
2,577,210 A 12/1951 Walter
2,676,547 A 4/1954 Knox
2,762,308 A 9/1956 Tomlinson
3,150,596 A 9/1964 Knox
3,735,815 A 5/1973 Myers
(Continued)

FOREIGN PATENT DOCUMENTS

CA 2164145 11/1996
CA 2527012 11/2005
(Continued)

OTHER PUBLICATIONS

Apergy Unlocking Energy, "PCS Multi-Stage Plunger Lift Equipment Catalog, Plunger Lift: Multi-Stage Plunger Tools," Oct. 2018, 2 pages.

(Continued)

*Primary Examiner* — Nicole Coy
*Assistant Examiner* — Nicholas D Wlodarski
(74) *Attorney, Agent, or Firm* — Fish & Richardson P.C.

(57) ABSTRACT

A wellbore lift system with spring-assisted plunger includes an elongate body, multiple propellers and a spring-loaded flow control assembly. The body can traverse through a wellbore. The wellbore can produce the hydrocarbons to the surface. The body defines an interior volume within which the multiple propellers are disposed. The propellers can spin radially in response to the well tool assembly traveling downhole through the wellbore. The spring-loaded flow control assembly is coupled to the propellers. The flow control assembly can, in response to the well tool assembly traveling downhole through the wellbore, permit fluid flow uphole of the well tool assembly, and can store potential energy in the spring. In response to the well tool assembly traveling uphole through the wellbore, the spring-loaded flow control assembly can prevent fluid flow downhole of the well tool assembly and discharge the potential energy in the spring.

13 Claims, 5 Drawing Sheets

(56) References Cited

U.S. PATENT DOCUMENTS

| | | | | |
|---|---|---|---|---|
| 3,749,119 | A | 7/1973 | Tausch et al. | |
| 4,009,753 | A | 3/1977 | McGill et al. | |
| 4,043,392 | A | 8/1977 | Gazda | |
| 4,211,279 | A | 7/1980 | Isaacks | |
| 4,366,861 | A | 1/1983 | Milam | |
| 4,531,228 | A | 7/1985 | Kazunori et al. | |
| 4,596,516 | A | 6/1986 | Scott et al. | |
| 4,723,606 | A | 2/1988 | Vinzant | |
| 4,813,481 | A | 3/1989 | Sproul et al. | |
| 4,846,281 | A | 7/1989 | Clary | |
| 5,211,242 | A | 5/1993 | Coleman et al. | |
| 5,263,683 | A | 11/1993 | Wong | |
| 5,271,725 | A | 12/1993 | Freet et al. | |
| 5,389,128 | A | 2/1995 | Lopes | |
| 5,431,228 | A | 7/1995 | Weingarten | |
| 5,472,054 | A | 12/1995 | Hinds et al. | |
| 5,516,360 | A | 5/1996 | Normandeau et al. | |
| 5,653,286 | A | 8/1997 | McCoy et al. | |
| 5,823,265 | A | 10/1998 | Crow | |
| 5,902,378 | A | 5/1999 | Obrejanu | |
| 6,079,491 | A | 6/2000 | Stuebinger et al. | |
| 6,089,322 | A | 7/2000 | Kelley et al. | |
| 6,092,599 | A | 7/2000 | Berry et al. | |
| 6,092,600 | A | 7/2000 | McKinzie | |
| 6,131,660 | A | 10/2000 | Stuebinger et al. | |
| 6,138,758 | A | 10/2000 | Shaw et al. | |
| 6,148,923 | A | 11/2000 | Casey | |
| 6,155,345 | A | 12/2000 | Lee et al. | |
| 6,179,056 | B1 | 1/2001 | Smith | |
| 6,216,788 | B1 | 4/2001 | Wilson | |
| 6,179,054 | B1 | 10/2001 | Stewart | |
| 6,367,547 | B1 | 4/2002 | Towers et al. | |
| 6,481,499 | B2 | 11/2002 | Lopes | |
| 6,494,258 | B1 | 12/2002 | Weingarten | |
| 6,571,868 | B2 | 6/2003 | Victor | |
| 6,705,404 | B2 | 3/2004 | Bosley | |
| 6,736,880 | B2 | 5/2004 | Ford et al. | |
| 6,808,020 | B2 | 10/2004 | Garcia | |
| 6,830,108 | B2 | 12/2004 | Rogers, Jr. et al. | |
| 6,932,160 | B2 | 8/2005 | Murray | |
| 6,945,762 | B2 | 9/2005 | Williams | |
| 6,966,366 | B2 | 11/2005 | Rogers, Jr. et al. | |
| 7,080,692 | B1 | 7/2006 | Kegin | |
| 7,188,670 | B2 | 3/2007 | Amies et al. | |
| 7,337,854 | B2 | 3/2008 | Horn et al. | |
| 7,665,528 | B2 | 2/2010 | Ross et al. | |
| 7,954,545 | B2 | 6/2011 | Hearn et al. | |
| 8,136,600 | B2 | 3/2012 | Fowler | |
| 8,181,706 | B2 | 5/2012 | Tanton | |
| 8,322,434 | B2 | 12/2012 | Fielding | |
| 8,424,611 | B2 | 4/2013 | Smith | |
| 8,475,147 | B2 | 7/2013 | Losinske | |
| 8,893,777 | B1 | 11/2014 | Garrett | |
| 8,950,473 | B2 | 2/2015 | Smith | |
| 8,985,221 | B2 | 3/2015 | Mazzanti | |
| 9,206,676 | B2 | 12/2015 | Quigley et al. | |
| 9,322,251 | B2 | 4/2016 | Mazzanti | |
| 9,470,073 | B2 | 10/2016 | Xiao et al. | |
| 9,518,458 | B2 | 12/2016 | Ellithorp | |
| 9,587,444 | B2 | 3/2017 | Agarwal | |
| 9,631,472 | B2 | 4/2017 | Reid et al. | |
| 9,670,758 | B2 | 6/2017 | Wilson | |
| 9,765,608 | B2 | 9/2017 | Sims | |
| 9,915,256 | B2 | 3/2018 | Bebak et al. | |
| 9,970,420 | B2 | 5/2018 | Wang et al. | |
| 10,174,752 | B2 | 1/2019 | Downing | |
| 10,364,658 | B2 | 7/2019 | Michel | |
| 10,443,354 | B2 * | 10/2019 | Murphree | E21B 33/128 |
| 10,920,559 | B2 | 2/2021 | Zahran | |
| 11,542,797 | B1 | 1/2023 | Zahran et al. | |
| 2002/0162662 | A1 | 11/2002 | Passamaneck | |
| 2003/0215337 | A1 | 11/2003 | Lee | |
| 2004/0238179 | A1 | 12/2004 | Murray | |
| 2005/0053503 | A1 | 3/2005 | Gallant | |
| 2005/0194149 | A1 | 9/2005 | Giaconnino | |
| 2005/0199551 | A1 | 9/2005 | Gordon | |
| 2006/0113072 | A1 | 6/2006 | Lee | |
| 2006/0249284 | A1 | 11/2006 | Victor | |
| 2006/0283791 | A1 | 12/2006 | Ross | |
| 2008/0135239 | A1 | 6/2008 | Edwards et al. | |
| 2008/0210429 | A1 | 9/2008 | Mcmillin et al. | |
| 2008/0230230 | A1 | 9/2008 | Giacomino | |
| 2009/0038788 | A1 | 2/2009 | Farris | |
| 2010/0038071 | A1 | 2/2010 | Scott et al. | |
| 2010/0147514 | A1 | 6/2010 | Swaringin | |
| 2010/0294507 | A1 | 11/2010 | Tanton | |
| 2011/0073322 | A1 | 3/2011 | Smith et al. | |
| 2011/0132593 | A1 | 6/2011 | Phloi-montri | |
| 2012/0318524 | A1 | 12/2012 | Lea et al. | |
| 2013/0068455 | A1 | 3/2013 | Brown et al. | |
| 2013/0319661 | A1 * | 12/2013 | Xiao | E21B 43/121 166/250.03 |
| 2015/0233228 | A1 | 8/2015 | Roth et al. | |
| 2015/0240596 | A1 | 8/2015 | Horwell | |
| 2015/0275633 | A1 | 10/2015 | Tolman et al. | |
| 2015/0292307 | A1 | 10/2015 | Best | |
| 2016/0130922 | A1 | 5/2016 | Wilson | |
| 2016/0222773 | A1 | 8/2016 | Sims | |
| 2016/0312589 | A1 * | 10/2016 | Decarlo | E21B 43/128 |
| 2016/0333681 | A1 | 11/2016 | Mazzanti | |
| 2017/0044882 | A1 | 2/2017 | Casey et al. | |
| 2017/0044883 | A1 | 2/2017 | Wilkinson et al. | |
| 2017/0081952 | A1 | 3/2017 | Osborne et al. | |
| 2017/0096884 | A1 | 4/2017 | Michel | |
| 2017/0218722 | A1 | 8/2017 | Gordon | |
| 2017/0328189 | A1 | 11/2017 | Wang et al. | |
| 2018/0334890 | A1 | 11/2018 | Stadler et al. | |
| 2019/0277118 | A1 * | 9/2019 | Boyd | E21B 43/121 |
| 2019/0292892 | A1 | 9/2019 | Zahran | |
| 2020/0141214 | A1 | 5/2020 | Kuykendall | |
| 2020/0386087 | A1 | 12/2020 | Gaglioti | |
| 2021/0032964 | A1 * | 2/2021 | Zahran | F04B 47/12 |
| 2021/0301635 | A1 | 9/2021 | Zahran | |

FOREIGN PATENT DOCUMENTS

| | | |
|---|---|---|
| CN | 2336113 | 9/1999 |
| CN | 201314221 | 9/2009 |
| CN | 203035167 | 7/2013 |
| CN | 203603854 | 5/2014 |
| CN | 205189837 | 4/2016 |
| CN | 109209305 | 1/2019 |
| EP | 2142755 | 3/2016 |
| GB | 2257185 | 1/1993 |
| GB | 2409691 | 2/2007 |
| GB | 2452370 | 3/2009 |
| WO | WO 2015167895 | 11/2015 |
| WO | WO 2016057011 | 4/2016 |
| WO | WO 2021021794 | 2/2021 |

OTHER PUBLICATIONS

Don-nan.com [online], "Gas Separator: Packer-style gas separator," available on or before Apr. 10, 2012, [retrieved on Sep. 7, 2018], retrieved from : URL <https://irp-cdn.multiscreensite.com/4497d96c/files/uploaded/DN%20GS%20PS.pdf>, 1 page.

Harbison Fisher, "Variable Slippage Pump," 2001, retrieved on Mar. 15, 2021, retrieved from URL <http://apergycdn.5thring.co.uk/HF_Variable_Slippage_Pump.pdf>, 8 pages.

Lufkin Oilfield Products Group, "2008/2009 General Catalog," 2008-2009, 72 pages.

McCoy et al., "Improved Downhole Gas Separators," presented at the Southwestern Petroleum Short Course, Apr. 7-8, 1998, 11 pages.

McCoy et al., "Downhole Gas Separators: A Laboratory and Field Study," presented at the Gas Well De-Liquification Workshop, Feb. 27-Mar. 1, 2006, 47 pages.

Odessaseparator.com [online], "OSI: Fluid Conditioning Systems," available on or before Apr. 7, 2017, via Internet Archive: Wayback Machine URL <https://web.archive.org/web/20170407235934/http://www.odessaseparator.com/products>, retrieved on Sep. 7, 2018, retrieved from URL <https://www.odessaseparator.com/products>, 4 pages.

(56) References Cited

OTHER PUBLICATIONS

Samayamantula, "An Innovative Design for Downhole Gas Separation," Don-Nan Pump and Supply Company, presented at the Oil and Gas Technology Webinar hosted by IEEE, Engineering 360, May 22, 2013, 16 pages.
Valbuena et al., "Defining the Artificial Lift System Selection Guidelines for Horizontal Wells," SPE-181229-MS, Society of Petroleum Engineers (SPE), presented at the SPE North American Artificial Lift Conference and Exhibition, Oct. 25-27, 2016, 20 pages.
Xu et al., "Rod Pumping Deviated Wells," Lufkin Automation, 2005, 14 pages.
International Search Report and Written Opinion in International PCT Appln. No. PCT/US2023/036761, dated Feb. 13, 2024, 14 pages.

* cited by examiner

WELLBORE LIFT SYSTEM WITH SPRING-ASSISTED PLUNGER

TECHNICAL FIELD

This disclosure relates to wellbore operations, for example, to recovering hydrocarbons through wellbores using enhanced oil recovery (EOR) techniques.

BACKGROUND

Hydrocarbons (e.g., oil, natural gas, combinations of them) trapped in a subsurface reservoir are raised to the surface (i.e., produced) through one or more wellbore formed from a surface of the Earth to the subsurface reservoir through a subterranean zone (e.g., a formation, a portion of a formation, multiple formations). To prepare a wellbore for production, the well is completed by installing well completions (i.e., well tools and associated hardware) within the wellbore. The hydrocarbons are pressurized by the subterranean zone in the subsurface reservoir such that, in primary hydrocarbon recovery operations, the pressure of the subterranean zone causes the hydrocarbons to flow from the subsurface reservoir through the wellbore to the surface. Over time, the pressure of the subterranean zone decreases. Then, artificial lift techniques are implemented to produce remaining hydrocarbons in the subsurface reservoirs. Plunger lift is an example of an artificial lift technique in which a plunger is dropped down a production string, and caused to reciprocate between uphole and downhole ends of the well. The reciprocating motion of the plunger drives hydrocarbons through the wellbore to the surface.

SUMMARY

This disclosure describes technologies relating to a wellbore lift system with spring-assisted plunger.

Certain aspects of the subject matter described in this disclosure can be implemented as a well tool assembly that includes an elongate body, multiple propellers and a spring-loaded flow control assembly. The elongate body can traverse through a wellbore formed from a surface of the Earth to a subsurface reservoir storing hydrocarbons. The wellbore can produce the hydrocarbons to the surface. The body defines an interior volume. The multiple propellers are disposed within the interior volume. The multiple propellers can spin radially in response to the well tool assembly traveling downhole through the wellbore. The spring-loaded flow control assembly is coupled to the multiple propellers. The flow control assembly can, in response to the well tool assembly traveling downhole through the wellbore, permit fluid flow uphole of the well tool assembly, and can store potential energy in the spring. In response to the well tool assembly traveling uphole through the wellbore, the spring-loaded flow control assembly can prevent fluid flow downhole of the well tool assembly and discharge the potential energy in the spring.

An aspect combinable with any other aspect includes the following features. The well tool assembly includes a spindle that can be positioned within the interior volume defined by the body. The multiple propellers are mounted to the spindle. The spindle can spin radially in response to the well tool assembly traveling downhole through the wellbore. The multiple propellers can spin in response to the spindle spinning.

An aspect combinable with any other aspect includes the following features. The spring-loaded flow control assembly includes a wind-up spring mounted to the spindle. The wind-up spring can be wound in response to the spindle spinning radially.

An aspect combinable with any other aspect includes the following features. The spring-loaded flow control assembly includes a clutch assembly mounted to the spindle. The clutch assembly can permit the spindle to spin in response to the well tool assembly traveling downhole through the wellbore and to prevent the spindle from spinning in response to the well tool assembly traveling uphole through the wellbore.

An aspect combinable with any other aspect includes the following features. The clutch assembly includes a cam latch that can prevent the spindle from spinning in response to the well tool assembly traveling uphole through the wellbore.

An aspect combinable with any other aspect includes the following features. The well tool assembly includes an actuation sleeve that can, in a first position, cause the cam latch to engage the spindle and prevent the spindle from spinning. The actuation sleeve is axially movable to a second position to disengage the spindle and to permit the spindle to spin.

An aspect combinable with any other aspect includes the following features. The actuation sleeve can move from the first position to the second position in response to an anvil of the well tool assembly contacting a bumper spring installed within the wellbore.

An aspect combinable with any other aspect includes the following features. The wind-up spring can release the stored potential energy causing the spindle to spin in response to the cam latch disengaging the spindle.

An aspect combinable with any other aspect includes the following features. The actuation sleeve can move from the second position to the first position in response to the wind-up spring releasing the potential energy.

An aspect combinable with any other aspect includes the following features. The well tool assembly includes a check valve that can permit fluid to unidirectionally flow from the interior volume defined by the body to a wellbore location uphole of the well tool assembly in response to the well tool assembly traveling downhole through the wellbore.

Certain aspects of the subject matter described here can be implemented as a method. While a well tool assembly having an elongate body defining an interior volume travels in a downhole direction through a wellbore formed from a surface of the Earth towards a subsurface reservoir storing hydrocarbons, well fluid is received within the interior volume. The received well fluid spins multiple propellers mounted to a spindle disposed within the interior volume. The multiple propellers spin the spindle in response to the received well fluid. A spring included in the well tool assembly and attached to the spindle stores potential energy in response to the spindle spinning. A check valve included in the well tool assembly unidirectionally flows the received well fluid to a wellbore location uphole of the well tool assembly. While the well tool assembly travels in an uphole direction through the wellbore, the stored potential energy is released to push the well fluid uphole of the well tool assembly towards the surface.

An aspect combinable with any other aspect includes the following features. A clutch assembly engages the spindle to permit spinning the spindle in response to the well tool traveling only in the downhole direction through the wellbore.

An aspect combinable with any other aspect includes the following features. The clutch assembly disengages the spindle to permit spinning the spindle in response to the well tool traveling in an uphole direction through the wellbore.

An aspect combinable with any other aspect includes the following features. The clutch assembly disengages the spindle in response to axial movement of an actuation sleeve from a first position when the well tool assembly travels in the downhole direction to a second position when the well tool assembly travels in the uphole direction.

An aspect combinable with any other aspect includes the following features. The actuation sleeve moves from the first position to the second position in response to the well tool assembly contacting a bumper spring installed within the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Artificial lift techniques implementing plungers (sometimes called plunger lift) are often used for wellbore artificial lift or well de-liquefaction. The plunger used in plunger lift is the component that functions to mechanically lift well fluid, e.g., hydrocarbons, from downhole locations to the surface. Certain plunger designs leverage the natural flow pressure of the wellbore to propel the plunger upwards to achieve hydrocarbon or well fluid displacement. This disclosure describes a plunger lift system in which the plunger itself provides additional kinetic energy to displace the hydrocarbon or well fluid from downhole locations towards a surface. As described in detail below, the plunger is implemented as a well tool assembly that uses the natural energy of the well to store potential energy within the plunger itself. The plunger then operates to convert the potential energy stored within the plunger into kinetic energy imparted to the hydrocarbons or the well fluid.

Implementing the techniques described here leverages existing well energy and gravity to provide a mechanism to store energy. The techniques described here have the potential to increase liquid/fluid removal due to increased plunger travel frequency. The assembly described below can operate free of any electrical power.

Figure 1:
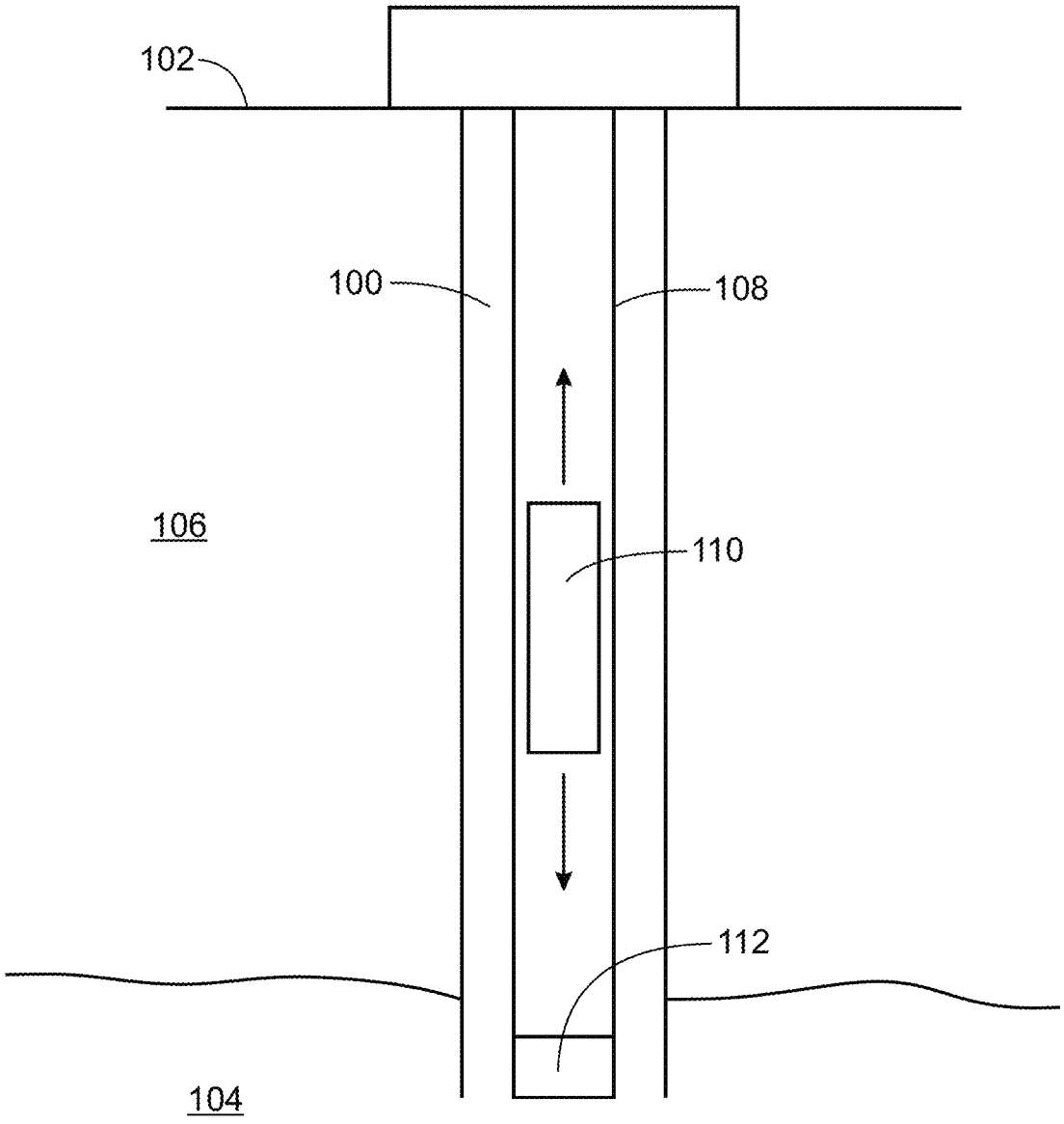
FIG. 1 is a schematic diagram of a well system implementing plunger lift.

FIG. 1 is a schematic diagram of a wellbore 100 implementing plunger lift. The wellbore 100 is formed from a surface 102 of the Earth to a subsurface reservoir 104 through a subterranean zone 106. Well fluids (not shown) including hydrocarbons in the subsurface reservoir 104 can be produced to the surface 102 through the wellbore 100. To do so, a production string 108 is installed within the wellbore 100. For example, the production string 108 can hang from a wellhead 110 installed at the entrance to the wellbore 100. In some implementations, artificial lift techniques are implemented in the wellbore 100 to produce the well fluids to the surface. Plunger lift is an example of such an artificial lift technique. To implement plunger lift, a well tool assembly 110 (e.g., a plunger) is dropped into the wellbore 100 from the surface 102. As the assembly 110 travels in a downhole direction through the wellbore 102 under gravity, the assembly 110 converts kinetic energy due to downhole travel of the assembly 110 through the well fluids into potential energy, which the assembly 110 stores (as described later). In addition, well fluids pass through the assembly 110 and are displaced from locations downhole of the assembly 110 to locations uphole of the well assembly 100.

When the assembly 110 contacts a bumper spring 112 installed at a downhole location within the wellbore 100, the assembly 110 reverses direction and begins to travel in an uphole direction. As described later, a construction of the assembly 110 prevents well fluids from passing from locations uphole of the assembly 110 to locations downhole of the assembly 110. In addition, a contact between the assembly 110 and the bumper spring 112 causes stored potential energy to be converted into kinetic energy. In this manner, a combination of a movement of the assembly 110 in the uphole direction together with a release of the stored potential energy as kinetic energy causes the well fluids uphole of the assembly 110 to be displaced towards the surface 102. After the assembly 110 completes travel in the uphole direction, the assembly 110 once again falls downhole under gravity and begins to store potential energy. The cycle of using energy of the well fluids to store potential energy and to impart the potential energy to drive well fluids to the surface 102 continues.

Figure 2:
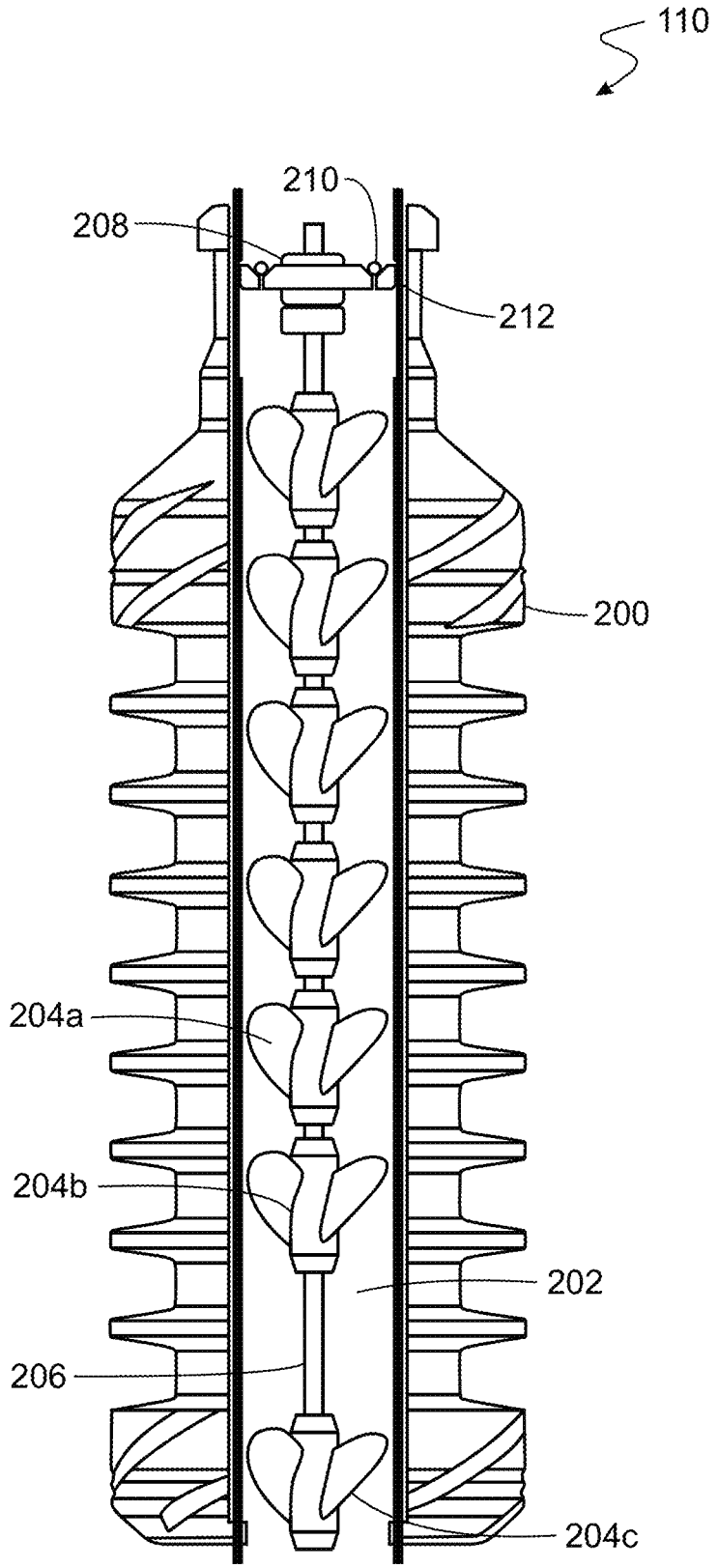
FIG. 2 is a schematic diagram of a well tool assembly used to implement plunger lift in the well system of FIG. 1.

FIG. 2 is a schematic diagram of the well tool assembly 110 (FIG. 1). The assembly 110 includes an elongate body 200 that can traverse through a wellbore (e.g., the wellbore 100). The body 200 defines an interior volume 202. For example, the body 200 can be a hollow cylinder. Multiple propellers (e.g., propellers 204*a*, 204*b*, 204*c*) are disposed within the interior volume 202. The propellers can spin radially in response to the assembly 110 traveling downhole or uphole through the wellbore 100. Specifically, the propellers can spin in one direction (e.g., clockwise or counter-clockwise) when traveling downhole, and spin in an opposite direction (e.g., counter-clockwise or clockwise) when traveling uphole. In some implementations, a spindle 206 is positioned within the interior volume 202. The propellers are mounted to the spindle 206. The spindle 206 can span almost an entire axial length of the body 200. The propellers can be mounted equidistantly along the length of the spindle 206. Each propeller is rotationally locked to the spindle 206 meaning that a spinning of the propellers causes the spindle 206 to spin, and a spinning of the spindle 206 causes the propellers to spin. Conversely, when the spindle 206 is prevented from spinning, the propellers do not spin.

The assembly 110 includes a spring-loaded flow control assembly 208 that is coupled to the multiple propellers. For example, the flow control assembly 208 can be mounted to or near an uphole end of the spindle 206. The flow control assembly 208 is configured to perform at least two functions. In response to the assembly 110 traveling downhole through the wellbore 100, the flow control assembly 208 permits fluid flow uphole of the assembly 110. Simultaneously, the flow control assembly 208 stores potential energy a spring (described later) included in the flow control assembly 208. The potential energy is converted from kinetic energy and other natural energy due to flow of well fluids through the wellbore 100. In response to the assembly 110 traveling uphole through the wellbore 100, the flow control assembly 208 prevents fluid flow downhole of the assembly 110. Simultaneously, the flow control assembly 208 discharges the potential energy stored in the spring. The discharged potential energy is converted to kinetic energy which serves to drive the well fluids uphole of the assembly 110 towards the surface 102 of the wellbore 100.

Figure 3:
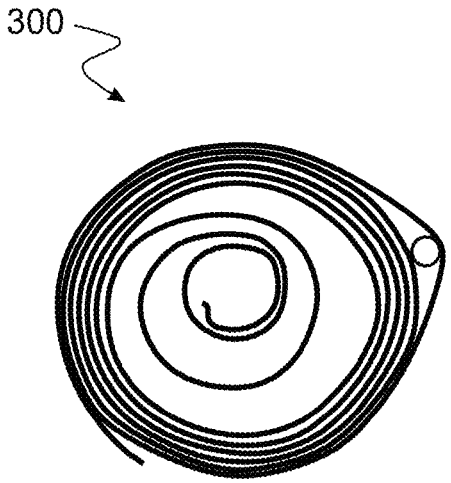
FIG. 3 is a schematic diagram of a spring used in the well tool assembly of FIG. 2.

In some implementations, the spring in the flow control assembly 208 is a wind-up spring. FIG. 3 is a schematic diagram of a wind-up spring 300 used in the assembly 110 (FIG. 1). The wind-up spring 300 is mounted to the spindle 206 (FIG. 2). When the spindle 206 spins in one direction, the spring 300 is wound-up. In this manner, kinetic energy of the spinning spindle 206 is stored as potential energy in the wound-up spring 300. When the spring 300 releases the stored potential energy by unwinding, the potential energy is converted is converted into kinetic energy causing the spindle 206 to once again spin. As described later, the conversion of kinetic energy of the spinning spindle 206 to potential energy stored in the spring 300 occurs during downhole travel of the assembly 110. During the downhole travel, the rotational energy exerted by the spindle 206 is stored by the spring 300. The conversion of potential energy stored in the spring 300 to kinetic energy of the spinning spindle 206 occurs during uphole travel of the assembly 110.

Figure 4:
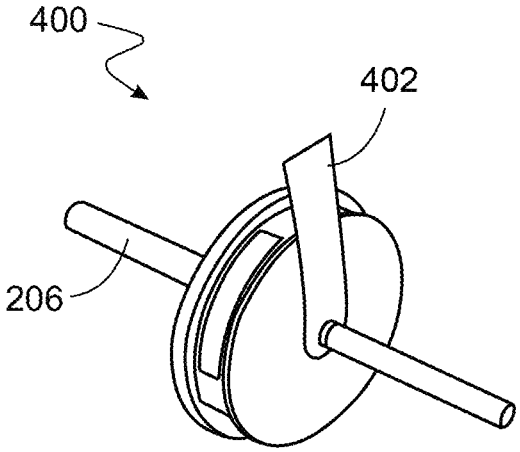
FIG. 4 is a schematic diagram of a clutch assembly used in the well tool assembly of FIG. 2.

In some implementations, the flow control assembly 208 includes a clutch assembly. FIG. 4 is a schematic diagram of a clutch assembly 400 used in the assembly 110 (FIG. 1). In some implementations, the clutch assembly 400 includes a cam latch 402 mounted to the spindle 206 (FIG. 2). The clutch assembly 400 is configured to control the direction in which the spindle 206 spins. For example, when the assembly 110 travels in a downhole direction through the wellbore 100, the clutch assembly 400 permits the spindle 206 to spin in one direction (i.e., clockwise or counter-clockwise) but not in the other. The direction in which the clutch assembly 400 permits the spindle 200 to spin depends on the orientation of the propellers mounted to the spindle 206. During downhole travel of the assembly 110, the propellers need to spin to convert kinetic energy including natural well energy (e.g., energy due to flow of well fluid) into potential energy of the spring 300 (FIG. 3). Consequently, the clutch assembly 400 permits the spindle 206 to spin with the propellers during downhole travel of the assembly 110, but prevents the spindle 206 from spinning in the opposite direction. Conversely, during uphole travel of the assembly 110, the spindle 206 needs to spin to convert the stored potential energy of the spring 300 (FIG. 3) into kinetic energy to drive well fluids to the surface 102 of the wellbore 100. Consequently, the clutch assembly 400 permits the spindle 206 to spin during uphole travel of the assembly 110, but prevents the spindle 206 from spinning in the opposite direction.

Figure 5:
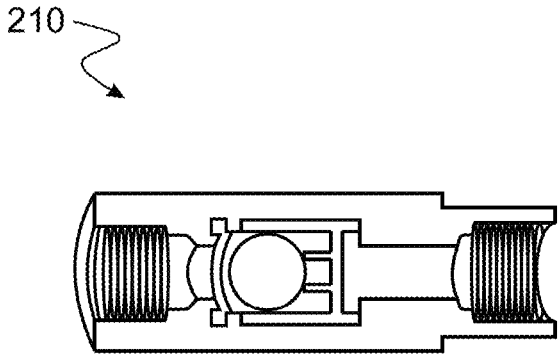
FIG. 5 is a schematic diagram of a check valve used in the well tool assembly of FIG. 2.

In some implementations, the assembly 110, e.g., the flow control assembly 208 includes a check valve 210 that permits fluid to unidirectionally flow from the interior volume 202 to a wellbore location uphole of the assembly 110 in response to the assembly 110 traveling downhole through the wellbore 100. FIG. 5 is a schematic diagram of a check valve 210 used in the assembly 110 (FIG. 1). Some implementations of the assembly 110 can deploy multiple check valves. As the assembly 110 travels downhole through the wellbore 100, well fluids within the interior volume 202 are propelled in an uphole direction. The check valve 210 (or check valves, in some implementations) permits the well fluid to pass through the uphole end of the assembly 110 towards a location uphole of the assembly 110. Conversely, as the assembly 110 travels uphole through the wellbore 100, the check valve 210 (or check valves) prevents the well fluid from passing through into the interior volume 202. In this manner, movement of the assembly 110 in the uphole direction causes the well fluid that is uphole of the assembly 110 to be pushed towards the surface 102.

Figure 6:
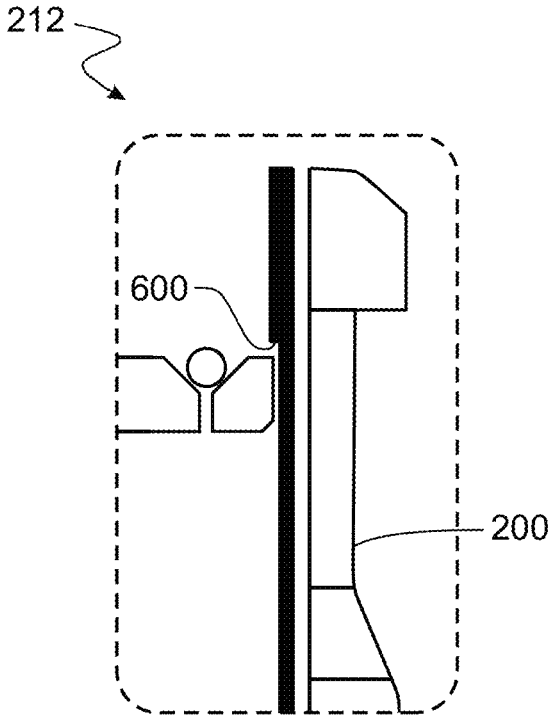
FIG. 6 is a schematic diagram of an actuation sleeve used in the well tool assembly of FIG. 2.
Figure 8B:
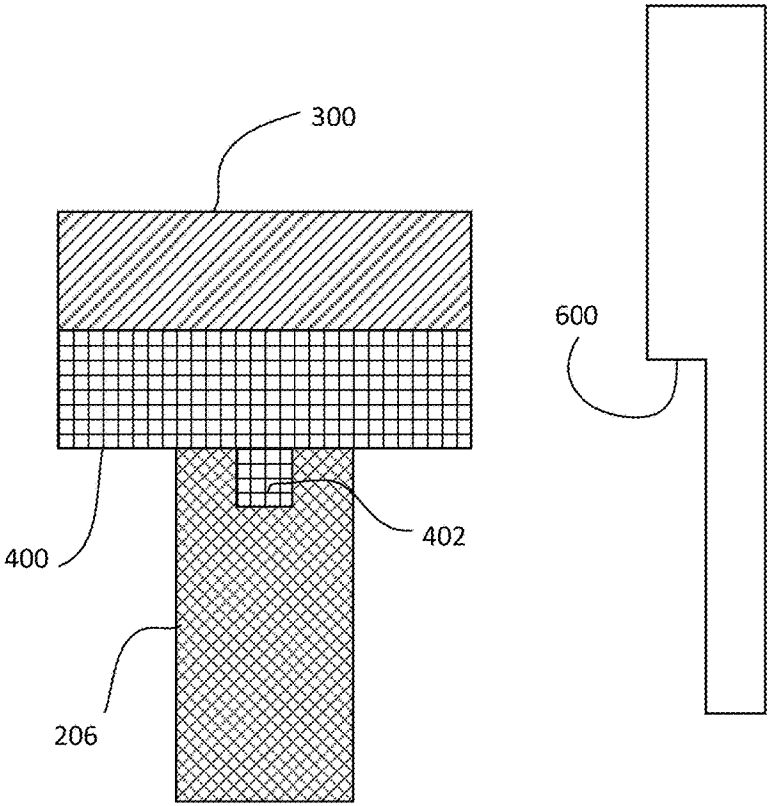
FIG. 8B is a schematic diagram of the clutch assembly disengaged by the actuation sleeve.
Figure 8A:
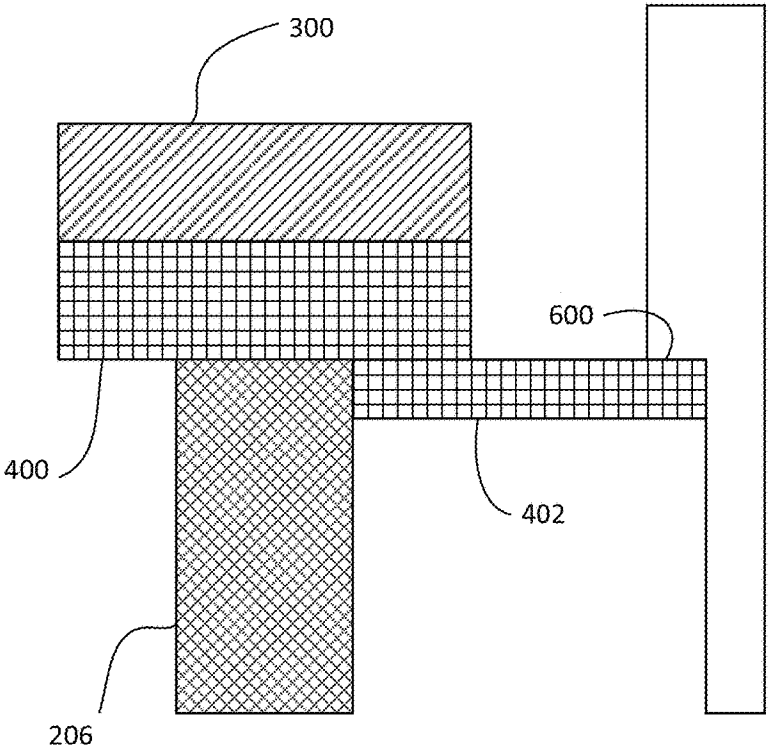
FIG. 8A is a schematic diagram of the clutch assembly engaged by the actuation sleeve.

In some implementations, the assembly 110 includes an actuation sleeve 212 that can move between a first position and a second position. FIG. 6 is a schematic diagram of an actuation sleeve 212 used in the assembly 110 (FIG. 1). In the first position (FIG. 8A), the actuation sleeve 212 causes the clutch assembly 400 (e.g., the cam clutch 402) to engage the spindle 206 and to prevent the spindle 206 from spinning. For example, the actuation sleeve 212 can include an elongate sleeve with a shoulder 600 nearer the uphole end of the spindle 206. The flow control assembly 208 can engage the shoulder 600 causing the clutch assembly 400 (specifically, the cam clutch 402) to prevent the spindle 206 from spinning as the assembly 110 travels downhole through the wellbore 100. When the assembly 110 (specifically, the anvil of the assembly 110) contacts the bumper spring 112, the actuation sleeve 212 slides in an uphole direction from the first position to the second position (FIG. 8B). The movement causes the clutch assembly 400 to release the spindle 206 (specifically, the cam clutch 402) and to permit the spindle 206 to spin as the spring 300 releases stored potential energy.

Figure 7:
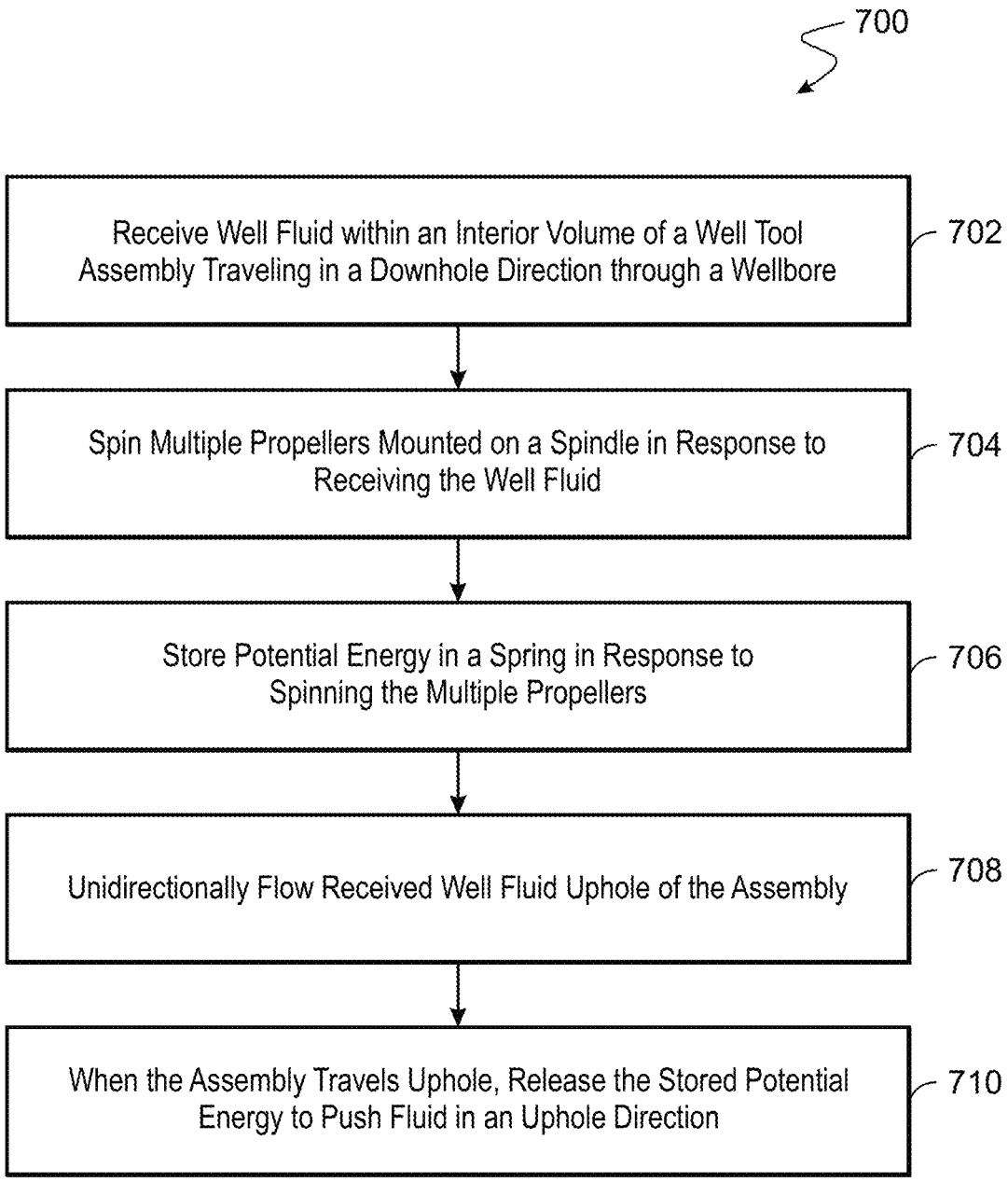
FIG. 7 is a flowchart of an example of a process of using the well tool assembly of FIG. 2.

FIG. 7 is a flowchart of an example of a process 700 of using the well tool assembly of FIG. 2. In some implementations, all or portions of the process 700 can be performed by the assembly 110 (FIG. 1). At 702, while the well tool assembly 110 travels in a downhole direction, the assembly 110 receives well fluid within the interior volume 202. The received well fluid spins multiple propellers mounted to a spindle 206 disposed within the interior volume 202. The clutch assembly 400 engages with the spindle 206 and allows spinning only in one direction (e.g., counter-clockwise direction). At 704, the spinning of the multiple propellers causes the spindle 206 to also spin. At 706, the spring 300 stores potential energy in response to the spindle spinning. The well fluids follow a tortuous flow path due to the positions of the multiple spinners. Doing so increases the conversion of energy from the well fluids to potential energy of the spring. Meanwhile, at 708, the check valve 210 allows well fluids that flow into the interior volume 202 to unidirectionally flow to a wellbore location uphole of the assembly 110. Upon completion of travel in the downhole direction, the assembly 110 contacts the bumper spring 112. The contact causes the actuation sleeve 212 to shift causing the clutch assembly 400 to disengage. In this arrangement, the spindle 206 can rotate as the spring 300 releases its stored potential energy.

At 710, while the assembly 110 travels in an uphole direction through the wellbore 100, the stored potential energy of the spring 300 is released to push the well fluid uphole of the assembly 100 towards the surface 102. In particular, the clutch assembly 400 will disengage upon shifting the actuation sleeve 212 upon impact with the bumper spring 112. During uphole travel of the assembly 110, the check valve 210 remain closed providing a surface area to assist in displacement of well fluids accumulated uphole of the assembly 110. The clutch assembly 400 (specifically, the cam latch) ensures that the spindle 206 can spin in only one direction and not the other. As the spring 300 releases its stored potential energy, centrifugal force is exerted on the spindle 206 causing the spindle 206 to spin. The lift on the well fluids caused by upward travel of the assembly 110 is further assisted by the centrifugal force on the spindle 206 due to the unwinding spring 300.

When the assembly 110 reaches the surface, the assembly 110 contacts an anvil (not shown) that re-engages the actuation sleeve 212, thereby locking the spindle 206 to spin only in one direction, i.e., the direction opposite to which the spindle 206 was spinning during uphole travel of the assembly 110. Gravity causes the assembly 110 to once again travel downhole within the wellbore 100, thereby re-starting the process 700.

Thus, particular implementations of the subject matter have been described. Other implementations are within the scope of the following claims.

The invention claimed is:

1. A well tool assembly comprising:

an elongate body configured to traverse through a wellbore formed from a surface of the Earth to a subsurface reservoir storing hydrocarbons, the wellbore configured to produce the hydrocarbons to the surface, the elongate body defining an interior volume;

a plurality of propellers disposed within the interior volume, the plurality of propellers configured to spin radially in response to the well tool assembly traveling downhole through the wellbore;

a spring-loaded flow control assembly coupled to the plurality of propellers, the flow control assembly configured, in response to the well tool assembly traveling downhole through the wellbore, to permit fluid flow uphole of the well tool assembly and to store potential energy in the spring, and, in response to the well tool assembly traveling uphole through the wellbore, to prevent fluid flow downhole of the well tool assembly and to discharge the potential energy in the spring; and a spindle configured to be positioned within the interior volume defined by the elongate body, wherein the plurality of propellers are mounted to the spindle, wherein the spindle is configured to spin radially in response to the well tool assembly traveling downhole through the wellbore, wherein the plurality of propellers are configured to spin in response to the spindle spinning, wherein the spring-loaded flow control assembly comprises a wind-up spring mounted to the spindle, wherein the wind-up spring is configured to be wound in response to the spindle spinning radially, wherein the wind-up spring is a radially winding spring.

2. The well tool assembly of claim 1, wherein the spring-loaded flow control assembly comprises a clutch assembly mounted to the spindle, the clutch assembly configured to permit the spindle to spin in response to the well tool assembly traveling downhole through the wellbore and to prevent the spindle from spinning in response to the well tool assembly traveling uphole through the wellbore.

3. The well tool assembly of claim 2, wherein the clutch assembly comprises a cam latch configured to prevent the spindle from spinning in response to the well tool assembly traveling uphole through the wellbore.

4. The well tool assembly of claim 3, further comprising an actuation sleeve configured, in a first position, to cause the cam latch to engage the spindle and to prevent the spindle from spinning, the actuation sleeve axially movable to a second position to disengage the spindle and to permit the spindle to spin.

5. The well tool assembly of claim 4, wherein the actuation sleeve is configured to move from the first position to the second position in response to an anvil of the well tool assembly contacting a bumper spring installed within the wellbore.

6. The well tool assembly of claim 4, wherein the wind-up spring is configured to release the stored potential energy causing the spindle to spin in response to the cam latch disengaging the spindle.

7. The well tool assembly of claim 6, wherein the actuation sleeve is configured to move from the second position to the first position in response to the wind-up spring releasing the potential energy.

8. The well tool assembly of claim 1, further comprising a check valve configured to permit fluid to unidirectionally flow from the interior volume defined by the elongate body to a wellbore location uphole of the well tool assembly in response to the well tool assembly traveling downhole through the wellbore.

9. A method comprising:

while a well tool assembly having an elongate body defining an interior volume travels in a downhole direction through a wellbore formed from a surface of the Earth towards a subsurface reservoir storing hydrocarbons, receiving well fluid within the interior volume, wherein the received well fluid spins a plurality of propellers mounted to a spindle disposed within the interior volume;

spinning, by the plurality of propellers, the spindle in response to the received well fluid;

storing, by a spring included in the well tool assembly and attached to the spindle, potential energy in response to the spindle spinning, wherein the spring is a wind-up spring mounted to the spindle, wherein the wind-up spring is wound in response to the spindle spinning, wherein the wind-up spring is a radially winding spring;

unidirectionally flowing, by a check valve included in the well tool assembly, the received well fluid to a wellbore location uphole of the well tool assembly; and while the well tool assembly travels in an uphole direction through the wellbore, releasing the stored potential energy to push the well fluid uphole of the well tool assembly towards the surface.

10. The method of claim 9, further comprising engaging, by a clutch assembly, the spindle to permit spinning the spindle in response to the well tool traveling only in the downhole direction through the wellbore.

11. The method of claim 10, further comprising disengaging, by the clutch assembly, the spindle to permit spinning the spindle in response to the well tool traveling in an uphole direction through the wellbore.

12. The method of claim 11, further comprising disengaging, by the clutch assembly, the spindle in response to axial movement of an actuation sleeve from a first position when the well tool assembly travels in the downhole direction to a second position when the well tool assembly travels in the uphole direction.

13. The method of claim 12, further comprising moving, by the actuation sleeve, from the first position to the second position in response to the well tool assembly contacting a bumper spring installed within the wellbore.

* * * * *